US005687665A

United States Patent [19]

Warkman

[11] Patent Number: 5,687,665

[45] Date of Patent: Nov. 18, 1997

[54] SHIPS

[75] Inventor: David Charles Warkman, Essex, United Kingdom

[73] Assignee: The British Petroleum Company, P.L.C., London, England

[21] Appl. No.: 585,764

[22] Filed: Jan. 16, 1996

[30] Foreign Application Priority Data

Jan. 20, 1995 [GB] United Kingdom ..... 9501169

[51] Int. Cl.[6] ..... B63B 25/08

[52] U.S. Cl. ..... 114/74 R

[58] Field of Search ..... 114/74 R, 74 A, 114/75, 125; 141/4, 11, 1, 63, 82

[56] References Cited

U.S. PATENT DOCUMENTS 4,389,959 6/1983 Conway ..... 114/74

FOREIGN PATENT DOCUMENTS

WO 94/18066 8/1994 WIPO .

*Primary Examiner*—Jesus D. Sotelo

*Attorney, Agent, or Firm*—Fay, Sharpe, Beall, Fagan, Minnich & McKee

[57] ABSTRACT

A ship having a fuel tank adjacent the hull of the ship, in which the tank is provided with at least one oil-tight bulkhead, longitudinal with respect to the hull, which bulkhead dividers the tank into two or more discrete compartments, at least one compartment being adjacent the hull and at least one compartment being remote from the hull, each compartment being provided with pipework such that each of said compartments independently of each other can be filled with fuel and can provide fuel to the engine and/or boiler systems of the ship.

8 Claims, 4 Drawing Sheets

SHIPS

Figure 1:
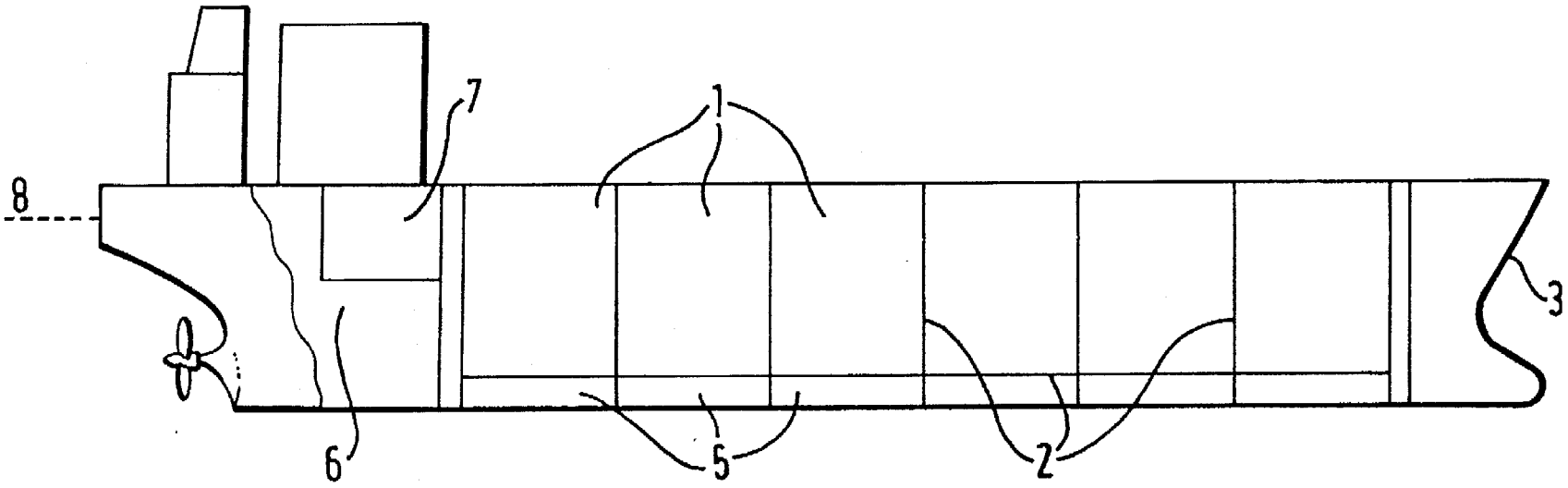

This invention relates to improvements in ships, specifically to an improved design in respect of the fuel tank or tanks of a ship.

When the hull of a ship is punctured in the area of a tank carrying oil, the contents of the ship may leak into the sea. In the case of oil tankers, puncture of oil cargo tanks has led on a number of occasions to major pollution of the environment by oil.

Modern designs for oil tankers avoid this problem by providing a double hull in the area of the cargo oil storage tanks. In such a design, an oil-tight compartment is provided between the hull of a ship and an oil-tight bulkhead, the bulkhead acting in effect as an inner hull of the ship. This compartment is designed to provide either a void space or to be filled with ballast water. In the event of a puncture, the inner hull remains intact, retaining the cargo of oil.

Such designs for oil cargo tanks are known, and are specified by legislation in some jurisdictions. However, in addition to the cargo tanks on an oil tanker, there are also fuel tanks which store the fuel for the ship. If the hull of the ship were punctured in the area of such a tank, oil could leak out. These tanks are normally located in the immediate vicinity of the engine room, relatively high in the ship. This area of the ship tends to be congested. If a double hull construction were to be adopted for these fuel tanks as well as for the cargo tanks, either the space available for the engine room would be much reduced, or the overall size of the ship would have to be increased, leading to considerable design problems or increased costs or both. Ships other than oil tankers also of course require protection for their fuel tanks.

We have now produced a new arrangement for the fuel tank or tanks of a ship which provides most of the advantages of the classical double hull construction while minimising costs and space requirements.

Accordingly the invention provides a ship having a fuel tank adjacent the hull of the ship, in which said tank is provided with at least one oil-tight bulkhead, longitudinal with respect to the hull, which bulkhead divides the tank into two or more discrete compartments, at least one compartment being adjacent the hull and at least one being remote from the hull, each compartment being provided with pipework such that each of said compartments independently of each other can be filled with fuel and can provide fuel to the engine and/or boiler systems of the ship.

The invention further provides a method of operating a ship according to the invention, which comprises charging each compartment of the fuel tank with fuel and subsequently extracting fuel from the tank to drive the engine of the ship; characterised in that the fuel is extracted from the or each compartment adjacent the hull of the ship and said compartments are emptied before fuel is extracted from the or each compartment remote from the hull of the ship.

The arrangement of compartments and pipework according to the invention means that on occasions when it is essential that the fuel tanks of the ship should be full, this can be achieved by filling all the compartments. Subsequently, fuel can be removed first from the compartment or compartments adjacent the hull of the ship. In the case, as in an oil tanker, where the fuel tanks are located relatively high in the ship relative to the water line, the level of oil in the compartments adjacent the hull will soon drop below the water line, and any puncture to the hull above the water line will in some circumstances not result in any leakage of oil into the water. Once such compartments have been emptied of fuel, fuel can be taken from compartments remote from the hull, and the empty compartments adjacent the hull provide a void space which has the same effect as a double hull construction. If the hull is punctured when fuel still remains within a compartment adjacent the hull, only a relatively small proportion of the total fuel in the tank is able to leak into the water. On occasions when less than a full tank of fuel is required at the beginning of a voyage, the fuel is loaded into the compartments furthest from the hull, immediately providing the benefits of a double hull construction.

In a preferred embodiment of the invention, the fuel tank is divided into two compartments by a single longitudinal oil-tight bulkhead. This provides one compartment running longitudinally adjacent the hull of the ship, and one compartment remote from the hull. However, other designs leading to larger numbers of compartments are possible, provided in all cases that when the fuel tanks are incompletely loaded, a void space may be provided adjacent the hull. It may be desired to provide larger numbers of compartments, particularly compartments remote from the hull, so that separate compartments can hold different types or grades of fuel, for example one compartment may hold fuel oil while another may hold diesel fuel.

Preferably the longitudinal bulkhead is made of the same specification material as the hull of the ship, so that if the hull is punctured, the bulkhead acts as an equivalent hull. Preferably, the whole of the compartment or compartments adjacent the hull are constructed of material with sufficient strength to become part of the hull envelope in the event of a puncture of the hull. However, in designs of ship such as in oil tankers, where the fuel tank is located relatively high in the ship relative to the water line, it may be unnecessary to provide a bulkhead of the same strength or thickness as the hull as any force experienced by the bulkhead in the event of puncture of the hull will be relatively low.

The present invention may be applied to any ship having a fuel tank. It may be applied to passenger and cruise ships, but preferably it is applied to a cargo vessel. The value of the invention is greatest where the capacity of the fuel tanks is relatively large, with a correspondingly large potential for damage in the event of a puncture of the hull. The invention is especially useful applied to an oil tanker. If the ship has two or more fuel tanks adjacent the hull, preferably each is arranged according to the invention.

The fuel tanks adjacent the hull may be situated anywhere in the ship. It is preferred that the tanks be coated with any suitable coating and fitted with vents, level gauging systems and over pressure protection means. Although not essential, it is desired that the tanks be capable of being cleaned by means of fixed or portable tank cleaning systems.

The dimensions of the compartments provided in the fuel tank or tanks depend on the dimensions of the ship. In the case of an oil tanker, where a single longitudinal bulkhead divides each tank into two compartments, it is convenient for the distance between the hull and the bulkhead to be from about 1 to about 3 meters, typically around 2 meters, providing convenient access to the compartment adjacent the hull. Suitably, the distance between the hull and the bulkhead is preserved over the full length and depth of the tanks. The relative dimensions of the two compartments provided is not significant, although clearly it is advantageous to maximise the volume of fuel which can be carried in the compartment remote from the hull, to enable the compartment adjacent the hull to be completely empty as often as possible, and to this end, the total volume of compartments remote from the hull is preferably at least twice as large as the volume of compartments adjacent the hull. Use of the present invention will protect from leakage all of the oil stored in compartments remote from the hull, together with in some circumstances some of the oil in the compartments adjacent the hull where the damage to the hull is above the waterline.

The arrangement of pipework serving the fuel tank is not critical provided that it can provide fuel independently to each of the compartments and it can extract fuel independently from each compartment, to run the engine and/or boiler systems of the ship. The compartments are preferably interconnected, but this must be arranged in such a way that the integrity of the compartment or compartments remote from the hull is not compromised in the event of a breach of the hull.

Figure 2:
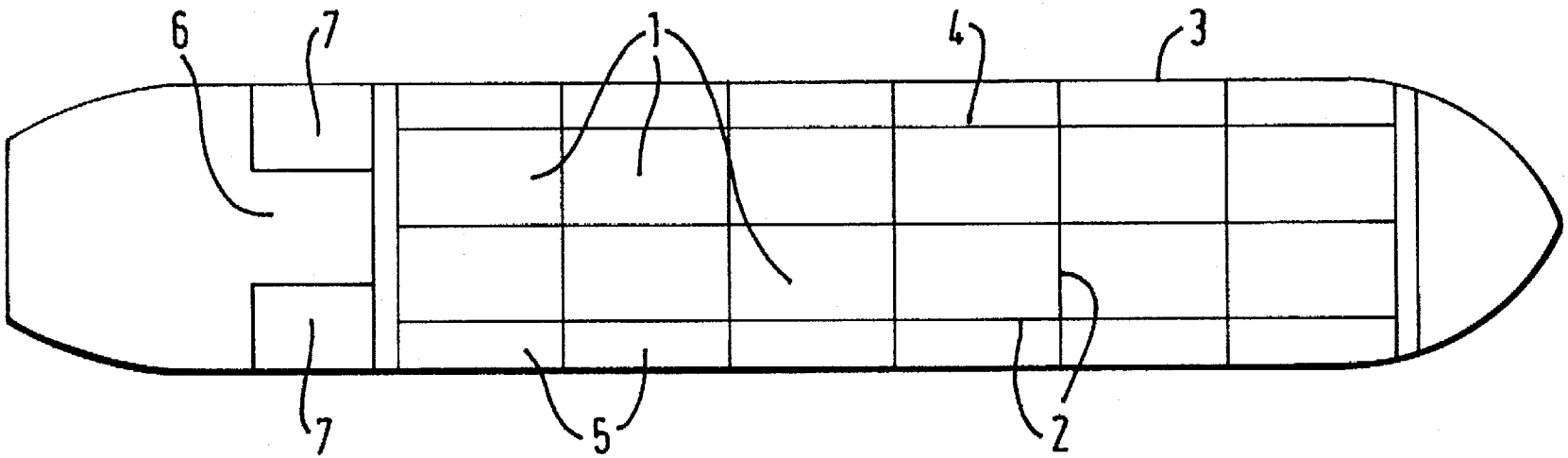
Figure 3:
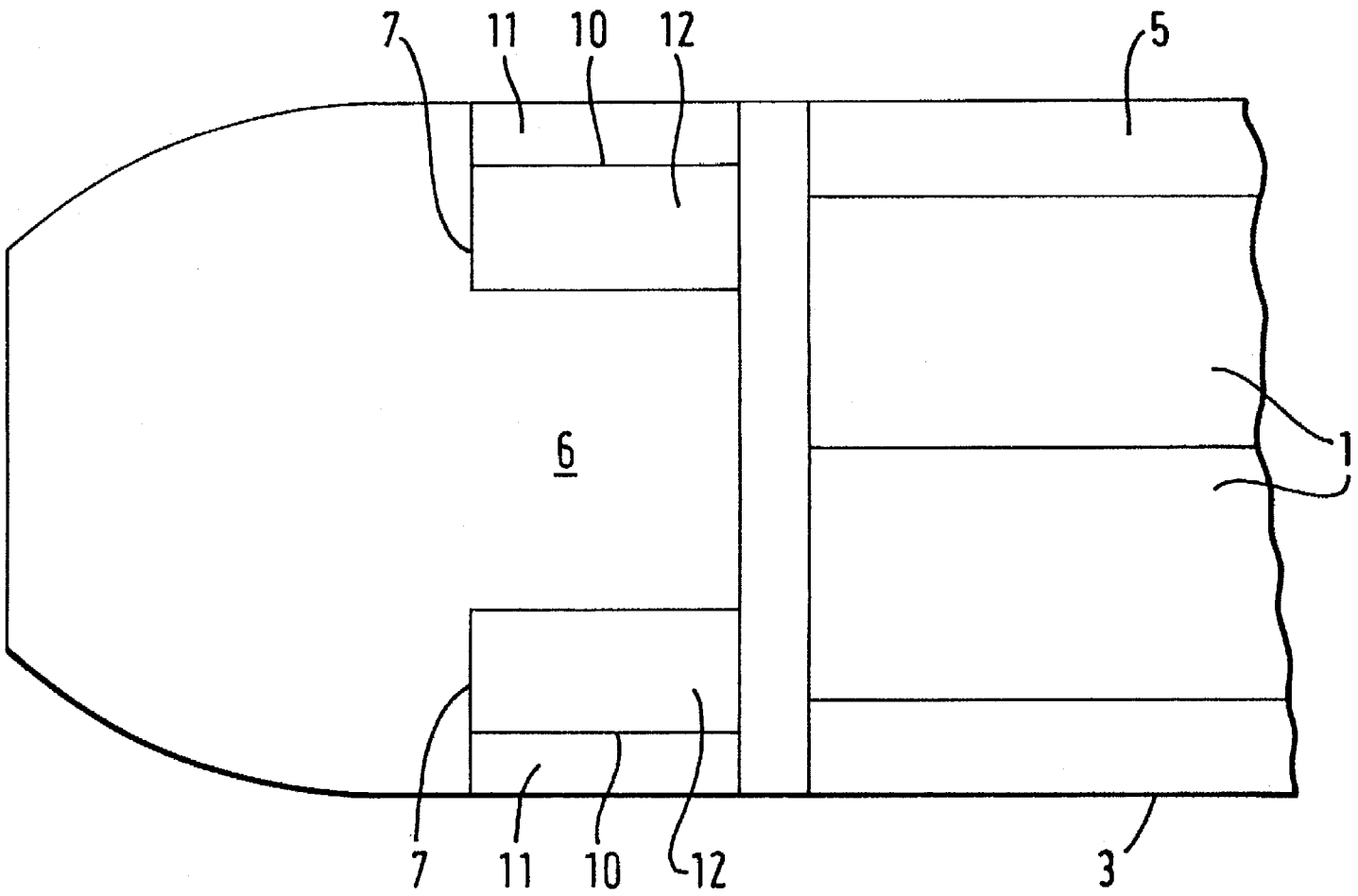
Figure 4:
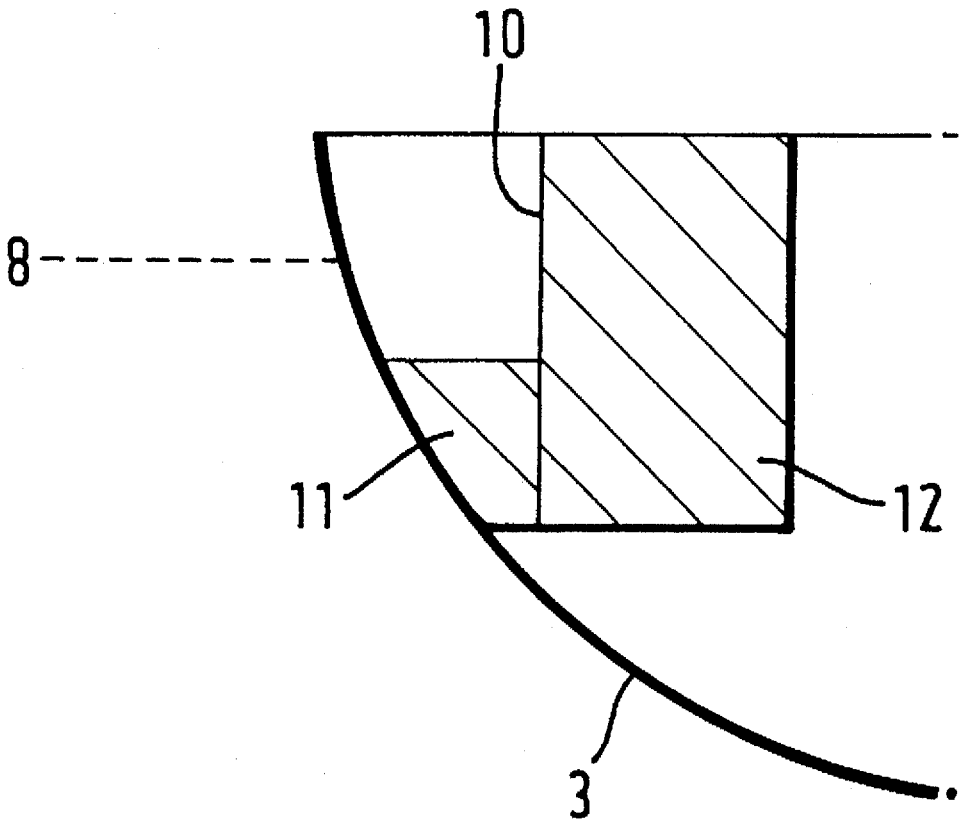

The invention will now be further described with reference to the accompanying drawings in which FIG. 1 is a side view of a conventional oil tanker of double hull construction; FIG. 2 is a plan view of the vessel of FIG. 1; FIG. 3 is a plan view of the fuel tank and engine room area of a vessel identical to that of FIG. 1 except that the fuel tanks are modified according to the invention; FIG. 4 is a plan view of the vessel of FIG. 3, partially loaded with fuel.

In the oil tanker of FIGS. 1 and 2, a plurality of oil cargo tanks (1) are defined by oil-tight bulkheads (2). The hull (3) of the vessel together with the bulkheads (4) located adjacent the hull define compartments (5) which may either provide a void space or be filled with ballast water. In the event of a puncture of the hull (3), the bulkhead (4) adjacent the hull acts to prevent leakage of oil from the tanks (1). Aft of the vessel, the area (6) houses the engine room and other machinery. Two fuel tanks (7) house the fuel required to power the vessel. When the vessel is fully loaded with cargo, the water line will be at level (8). Puncture of the hull in the vicinity of a fuel tank (7) could lead to leakage of all or most of the fuel stored in that tank.

In the vessel of FIGS. 3 and 4 constructed in accordance with the invention, an oil-tight bulkhead (10), longitudinal with respect to the hull (3), divides each fuel tank (7) into two compartment, one compartment (11) adjacent the hull (3) and one compartment (12) remote from the hull (3). Pipework (not shown) connects both compartments (11) and (12) to the engine and for boiler systems and permits loading of both compartments (11) and (12) with fuel.

In use, fuel is loaded into compartments (11) and (12) if a full load of fuel is required, and into compartment (12) only if this provides sufficient capacity. The pipework is arranged such that in use fuel is always taken preferentially from compartment (11) to empty this compartment as soon as possible. FIG. 4 illustrates the situation where a small proportion, perhaps around 10%, of the total capacity of the fuel tank (7) is empty. A puncture of the hull (3) above the waterline would not cause any leakage of oil from the vessel. A puncture below the waterline could cause leakage only of that relatively small quantity of oil remaining in compartment (11). In contrast, in a conventional vessel according to FIG. 1, any puncture of a fuel tank (7) below the waterline would risk loss of all the fuel in the tank, and puncture above the waterline would risk loss of a significantly greater quantity of oil than in the situation illustrated in FIG. 4.

I claim:

1. A ship having a fuel tank adjacent the hull of the ship, in which said tank is provided with at least one oil-tight bulkhead, longitudinal with respect to the hull, which bulkhead divides the tank into two or more discrete compartments, at least one compartment being adjacent the hull and at least one compartment being remote from the hull, each compartment being provided with pipework such that each of said compartments independently of each other can be filled with fuel and can provide fuel to the engine and/or boiler systems of the ship.

2. A ship according to claim 1 in which the fuel tank is divided into two compartments by a single longitudinal oil-tight bulkhead.

3. A ship according to claim 1, in which the bulkhead is made of the same specification material as the hull of the ship.

4. A ship according to claim 1, which is a cargo ship.

5. A ship according to claim 1, which is an oil tanker.

6. A ship according to claim 1, in which the distance between the hull and the bulkhead is in the range of from 1 to 3 meters.

7. A ship as claimed in claim 1, wherein the pipework is provided such that the fuel is extracted from the or each compartment adjacent the hull of the ship to drive the engine of the ship and said compartments are emptied before fuel is extracted from the or each compartment remote from the hull of the ship.

8. A ship according to claim 2, in which the bulkhead is made of the same specification material as the hull of the ship.

* * * * *